US005292635A

United States Patent [19]

Lok

[11] Patent Number: 5,292,635

[45] Date of Patent: Mar. 8, 1994

[54] THIOSULFONATE-SULFINATE STABILIZERS FOR PHOTOSENSITIVE EMULSIONS

[75] Inventor: Roger Lok, Rochester, N.Y.

[73] Assignee: Eastman Kodak Company, Rochester, N.Y.

[21] Appl. No.: 634,407

[22] Filed: Dec. 27, 1990

[51] Int. Cl.[5] ..... G03C 1/34; G03C 1/09

[52] U.S. Cl. ..... 430/611; 430/608; 430/613; 430/603

[58] Field of Search ..... 430/606, 608, 611, 613, 430/603

[56] References Cited

U.S. PATENT DOCUMENTS

| | | | |
|---|---|---|---|
| 2,394,198 | 2/1946 | Mueller . | |
| 2,440,206 | 4/1948 | Mueller . | |
| 3,047,393 | 7/1962 | Herz et al. . | |
| 3,728,126 | 4/1973 | Pollet et al. | 430/611 |
| 4,302,525 | 11/1981 | Baker et al. | 430/613 |
| 4,547,452 | 10/1985 | Toya | 430/611 |
| 4,960,689 | 10/1990 | Nishikawa et al. | 430/603 |
| 5,021,336 | 6/1991 | Reuss et al. | 430/608 |
| 5,110,719 | 5/1992 | Shuto et al. | 430/608 |

FOREIGN PATENT DOCUMENTS

| | | |
|---|---|---|
| 0358170 | 3/1990 | European Pat. Off. . |
| 0393477 | 10/1990 | European Pat. Off. . |

OTHER PUBLICATIONS

F. W. H. Mueller, "Review of Mechanism of Emulsion Stabilizers and Antifogging Agents," in *The Photographic Image; Formation and Structure,* S. Kikuchi, ed., The Focal Press, New York, New York, 1970, pp. 91-106.

*Primary Examiner*—Charles L. Bowers, Jr.
*Assistant Examiner*—Mark F. Huff
*Attorney, Agent, or Firm*—Paul A. Leipold

[57] ABSTRACT

A method for reducing speed change, or both speed change and fog growth, on aging in a photographic material composed of a silver chloride or silver bromochloride emulsion, by treating the emulsion with a thiosulfonate compound and a sulfinate compound, and the photographic emulsion and materials resulting from such treatment.

21 Claims, No Drawings

THIOSULFONATE-SULFINATE STABILIZERS FOR PHOTOSENSITIVE EMULSIONS

TECHNICAL FIELD

This invention relates generally to silver halide photographic materials, and, in particular, to methods for reducing speed change and fog growth during storage which are particularly well-suited for predominantly silver chloride emulsions. The present invention also relates to a photographic material resistant to speed change and fog growth upon storage.

BACKGROUND OF THE INVENTION

Silver halide crystals have been the dominant photosensitive material in photographic processes for more than a century. During this time, technological improvements in sensitivity have produced a broad range of materials with specialized photographic properties applicable to a broad spectrum of uses.

Modern photographic emulsions consist of a very large number of tiny silver halide crystals dispersed in a polymeric matrix, typically a colloid such as gelatin. Emulsions can be prepared with silver chloride, silver bromide, or silver iodide, or with mixtures of these halides. When light of the appropriate wavelength strikes a silver halide crystal, a series of reactions begins which generates an electron and eventually leaves in the crystal a small amount of free, zero-valent silver. The presence of this free silver in the exposed crystals provides a latent image, which is an invisible precursor of the visible image that is obtained upon subsequent photographic development.

The preparation of a photographic material generally includes several steps such as precipitation of the crystals in the colloid to form a primitive emulsion, chemical sensitization and spectral sensitization of the emulsion, and coating of the finished emulsion on a support. The photographic properties or overall sensitivity of an emulsion are dependent upon many variables which may be controlled at the various steps in the photographic process. Factors which influence sensitivity of freshly prepared emulsions include the composition (proportion of halides), average size and morphology (shape) of the crystals, the type of chemical and spectral sensitization used, and agents or addenda used to improve coating properties. For example, the most sensitive emulsions usually employ silver bromide crystals. Silver chloride is usually employed in some slow emulsions.

A vexatious problem in the photographic art is the change in photographic properties which occurs upon the aging of emulsion coatings. Photographic characteristics can change during storage as a result of elevated temperature, or as a result of chemical reactions of agents contained in the original coating or of agents from the atmosphere, from the coating support or from the packaging materials. The effects of environment on the aging of emulsions differ with halide composition, chemical sensitization and spectral sensitization.

Some photographic emulsions, in particular, silver chloride emulsions, exhibit an aging pattern in which photographic speed and fog increase during storage. Fog is a deposit of silver or dye that is not directly related to the image-forming exposure, i.e., when a developer acts upon an emulsion layer, some reduced silver is formed in areas that have not been exposed to light. Fog can be defined as a developed density that is not associated with the action of the image-forming exposure, and is usually expressed as "$d_{min}$", the density obtained in the unexposed portions of the emulsion. A density, as normally measured, includes both that produced by fog and that produced by exposure to light.

Several approaches have been described to reduce the storage-related changes in photographic properties. Certain agents can be added to emulsions to attempt to minimize these changes. Agents, known as stabilizers, can be added that decrease the changes in developable fog and/or other sensitometric characteristics of the emulsion coating that occur during storage. Other agents, known as antifoggants or fog restrainers, can be added that decrease the rate of fog density growth during development to a greater degree than they decrease the rate of image growth. Some agents act in both capacities; others may act in only one capacity, or their action may be restricted to particular types of fog development or other aging changes or both. Their quantitative, and sometimes their qualitative, action depends upon the concentration as well as the chemical composition of the agents. Additionally, many agents have limitations in their ability to produce desirable results without producing undesirable side effects. For example, some agents can be added only at specific steps in the photographic process or these agents may, for example, contribute to fog growth or desensitize the emulsion.

Several methods, using certain sulfur-containing (and analogous selenium-containing) compounds, have been described for reducing fogging. For example, U.S. Pat. No. 2,057,764 discloses the incorporation of sulfinic and seleninic acids or salts thereof into the emulsion, the emulsion support or the emulsion coating protective layer, or alternatively, bathing the emulsion layer in solutions of these compounds. U.S. Pat. Nos. 2,394,198 and 2,440,206 disclose the use of certain sulfinic and seleninic acids and their salts in combination with certain thiosulfonate compounds and polythionic acids or salts thereof. European Patent Application Publication 293,917 discloses use of certain thiosulfonate compounds as antifoggants in emulsions in which the silver salts are at least 50 mole% silver chloride. European Patent Application Publication 327,066 discloses the use of certain thiosulfonate compounds in direct positive emulsions.

Similar sulfur-containing compounds have also been described as beneficial in preventing or reducing other types of fog and staining, as well as improving other photographic properties. For example, U.S. Pat. No. 4,198,246 discloses the use of certain thiosulfonate compounds to reduce fog caused by use of thioethers in the precipition step of emulsion preparation, while U.S. Pat. No. 4,276,374 discloses the use of certain thioether compounds to reduce the same type of fog. A combination of certain sulfinates and sulfonate compounds has been disclosed as controlling the formation of stains in developed white background (European Patent Application Publication 305,926). The use of thiosulfonic acid esters in conjunction with 2-equivalent magenta dye couplers has been described to improve the efficiency of color formation (U.S. Pat. No. 4,868,099).

Despite attempts to provide photographic emulsions which maintain photographic speed upon storage, yet control fog growth, the art has not provided a photosensitive material having features that adequately address these considerations.

SUMMARY OF THE INVENTION

The present invention provides methods for reducing aging changes upon storage in a silver halide photographic material by treatment of the emulsion with a compound of formula I as defined hereinbelow and a compound of formula II as defined hereinbelow.

In one embodiment, the invention provides a method for reducing speed change in a photographic material, which material includes a negative photographic emulsion having predominantly silver chloride crystals. The combination of compounds of formulas I and II may be added during any step in the photographic process for producing a photographic material. In an illustrated embodiment, the formula I-formula II combination is added to the emulsion just prior to coating on a support. The compound of formula I is preferably incorporated in an amount of about 0.01 mmole to about 10 mmoles per mole silver, especially about 0.01 mmole to about 1.0 mmole per mole silver. The compound of formula II is preferably incorporated in an amount of about 0.5 mole to about 20 moles per mole of compound of formula I, preferably 5 moles to about 20 moles per mole of compound of formula I.

In another embodiment, the present invention provides a photosensitive emulsion which is resistant to speed change and fog growth resulting from storage. The emulsion is a colloid-silver halide photographic emulsion that has crystals of a compound selected from the group consisting of silver chloride and silver bromochloride, and includes a composition which comprises a compound of formula I and a compound of formula II. The concentration of the compound of formula I is about 0.01 to about 10 mmoles per mole of silver, and that of the compound of formula II is about 0.5 to about 20 moles per mole of compound of formula I.

One form of the photographic emulsion in accordance with the present invention includes silver bromochloride crystals consisting essentially of 50 to 100 mole percent chloride and 0 to 50 mole percent bromide.

An advantage of the invention is reducing fog growth upon storage of the photographic material without gain of photographic speed. The method of the invention is also simple and readily incorporated into typical photographic preparative techniques without the need for additional process steps.

Other advantages and a fuller appreciation of the specific adaptation, compositional variation, and physical attributes of the present invention will be gained upon an examination of the following detailed description of the invention.

DETAILED DESCRIPTION

The present invention provides a method for treating a photographic emulsion in which the photographic material formed from the emulsion is characterized by an ability to resist aging changes associated with storage of photographic materials. These attributes are achieved through a novel treatment of the emulsion with a combination of compounds.

In the following description of the method of the invention, process steps are carried out and concentrations are measured at room temperature (about 20° C. to about 25° C.) and atmospheric conditions unless otherwise specified.

As used herein, and generally used in the art, when referring to a mixed silver halide, the anion which is predominantly present is named last. For example, the designation "silver bromochloride" is meant to refer to a silver halide in which the crystals are predominantly silver chloride, i.e., present as 50 mole % or greater, but bromide is incorporated into the silver chloride structure. The term "emulsion" as used herein and in the art is meant to designate a dispersion of photosensitive crystals in a protective colloid, or designate the photosensitive layer that is coated on a support to provide a photographic material (e.g., film).

In one of its aspects, the invention is a method for reducing speed change on aging in a silver halide photographic material which comprises a photographic emulsion comprising crystals of a compound selected from the group consisting of silver chloride and silver bromochloride. Such an emulsion is preferably a negative emulsion, and is preferably monodisperse. The emulsion is black and white or color.

The method according to the present invention comprises treating the emulsion with an amount effective for reducing photographic speed change upon storage of the photographic material of a compound of formula I:

$$Z^1—X^1O_2S—M^1 \quad (I)$$

and a compound of formula II:

$$Z^2—X^2O_2—M^2 \quad (II)$$

wherein $X^1$ is sulfur and $X^2$ is selected from the group consisting of sulfur and selenium, $M^1$ and $M^2$ are independently selected from the group consisting of a metal ion and

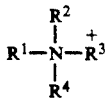

wherein $R^1$, $R^2$, $R^3$ and $R^4$ are independently selected from the group consisting of hydrogen and an alkyl of 1-3 carbon atoms, and $Z^1$ and $Z^2$ are independently selected from the group consisting of an unsubstituted or substituted alkyl of 1 to 22 carbon atoms, an alkenyl of 2 to 22 carbon atoms, an alkynyl of 2 to 22 carbon atoms, an unsubstituted or substituted aryl group having 6 to 20 carbon atoms, an unsubstituted or substituted 5 to 15-membered heterocyclic group having one or two heteroatoms, and L, wherein L is a divalent linking group. Examples of suitable aryl groups are phenyl, tolyl, naphthyl, cycloheptatrienyl, cyclootatrienyl, and cyclononatrienyl. Examples of suitable heterocyclic groups are pyrrolyl, furanyl, tetrahydrofuranyl, thiofuranyl, pyridino, picolino, piperidino, morpholino, pyrrolidino, thiophene, oxazole, thiazole, imidazole, selenazole, tellurazole, triazole, tetrazole and oxadiazole. Examples of suitable L groups are $—(CH(CH_2)_m)—$ where m=1 to 11, $—(CH—CH=CH—CH_2)—$, and $—(C(CH_3)CH_2)—$. When $Z^1$ or $Z^2$ is L, the compound of formula I or II, respectively, is polymeric, with the repeating unit being of formula I or formula II, respectively.

In a preferred embodiment, $X^1$ and $X^2$ are sulfur, $M^1$ and $M^2$ are independently selected from $Na^+$, $K^+$ and

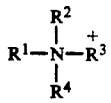

and $Z^1$ and $Z^2$ are independently selected from an unsubstituted phenyl group or a phenyl group substituted in one or two positions independently with a functional group selected from the group consisting of an alkyl having 1 to 10 carbon atoms, an alkoxy having 1 to 10 carbon atoms, an acyl having 1 to 10 carbon atoms, an hydroxyl, a phenyl, a tolyl, a naphthyl, a carboxy, a chloro, a bromo, a nitro, a cyano, an acetamido, a carbamoyl, an ureido, an unsubstituted amino, and an amino substituted with one or two alkyls being the same or different and each having 1 to 3 carbon atoms. In a more preferred embodiment, $M^1$ and $M^2$ are each $Na^+$ or $K^+$, and $Z^1$ and $Z^2$ are each a tolyl group. Most preferred are the $Na^+$ or $K^+$ salts of p-toluene thiosulfonate and p-toluene sulfinate.

Compounds of formula I and II can be synthesized by methods known in the art and described, for example, in *Journal of Organic Chemistry,* vol. 53, p. 386 (1988) and *Chemical Abstracts,* vol 59, 9777e. The most preferred compounds, sodium or potassium p-toluene thiosulfonate and p-toluene sulfinate, are commercially available.

In accordance with the present invention, the compounds of formulas I and II are present in the emulsion in an amount of between about 0.01 to about 10 mmoles of compound of formula I per mole silver and between about 0.5 to about 20 moles of compound of formula II per mole compound of formula I. (If a compound of formula I or II is a polymer, each repeating unit, which includes a moiety of formula $—X^1O_2S—$ (formula I) or $—X^2O_2—$ (formula II), respectively, is counted in determining the number of moles of the compound of the formula).

The compounds of formulas I and II may be added to the emulsion at any time in the preparation of the photographic material. The photographic emulsion is prepared by precipitating silver halide crystals in a colloidal matrix by methods conventional in the art. The silver halide is typically pure silver chloride (AgCl) or silver bromochloride with a bromide content from about 0 to 50 mole percent per mole silver. The colloid is typically a hydrophilic film forming agent such as gelatin, alginic acid, or derivatives thereof.

The crystals formed in the precipitation step are chemically and spectrally sensitized, as known in the art. Chemical sensitization of the emulsion employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum and diethylsenide; and polymeric agents, e.g., polyalkylene oxides. Spectral sensitization is effected with agents such as sensitizing dyes. For color emulsions, dyes are added in the spectral sensitization step using any of a multitude of agents described in the art, such as the publicly available Research Disclosure Item 17643, Section IV.

After spectral sensitization, the emulsion is coated on a support. Various coating techniques include dip coating, air knife coating, curtain coating and extrusion coating. Suitable supports conventional in the art include paper, cellulose esters, acetates or acetobutyrates, polyesters, polycarbonates glass or metal.

The compounds of formulas I and II may be added at any step in the process of preparing and treating the emulsion prior to applying it to a support. Thus, the compounds may be added separately or together directly to the emulsion as solids or dissolved in an aqueous solution, or added as a component in the dye coupler solution in the case of color emulsions, and may be added to any color layer—magenta, yellow or cyan. The preferred time of addition is just prior to coating.

In another aspect, the invention involves a method of reducing both speed gain and fog growth during storage in a photographic material which comprises a photographic emulsion of silver chloride or silver bromochloride crystals by treating the emulsion with compounds of formula I as defined hereinabove and of formula II as defined hereinabove. It has been found that the reduction in both speed gain and fog growth during storage of the photographic material is effected when the emulsion is applied to a paper support to form the photographic material. It has also been found that further reduction in aging changes is possible by applying the emulsion to a neutral pH paper support. The pH of a paper such as, for example, EKTACOLOR 2001, commercially available from Eastman Kodak Company (Rochester, N.Y., USA) can be adjusted to a neutral pH of about 6.5 to 7.0 by dipping in a bath of sodium bicarbonate or sodium hydroxide. These methods constitute additional aspects of the present invention.

It has also been found that the combined presence, in the emulsion, of compounds of formulas I and II with other agents provides further reduction in speed change and fog growth. Prior to coating the emulsion treated with compounds of formulas I and II in accordance with the present invention, an aqueous-soluble chloride salt (hereinafter referred to simply as a "soluble" chloride salt), such as an alkali chloride or ammonium chloride, but preferably potassium chloride (KCl), is added to the emulsion. -The amount of KCl is added such that its coating density is about 1 to 20 $mg/ft^2$, preferably 1 to 5 $mg/ft^2$. Although use of chloride salts as anti-fogging and a stabilizing agents is known, the effect of combining antifoggants is known to be unpredictable, sometimes resulting in interference of the antifogging effects of some or all of the combined compounds. Suprisingly, then, it has been found that the advantageous effects of the presence of compounds of formulas I and II are added to those of the soluble chlorides, such as sodium or potassium chloride.

Additional reduction in speed change and fog growth is also effected if, prior to coating the emulsion treated with the compounds of formulas I and II in accordance with the present invention, the pH of the emulsion is adjusted to a range of about 4.5 to about 6.0, preferably about 5.0 to about 5.4. The pH is adjusted by addition of a solution of a strong acid such as nitric acid ($HNO_3$). The pH adjustment can be effected at any time in the preparation of the emulsion, but is conveniently added after treatment with the compounds of formulas I and II. An advantageous additive effect is also obtained if the emulsion, adjusted to acidic pH, is treated with a soluble chloride, such as sodium chloride or potassium chloride.

In another of its aspects, the invention is a photographic emulsion comprising a colloid-silver halide photographic emulsion comprising (1) crystals selected from the group consisting of silver chloride and silver bromochloride, and (2) a composition comprising, in amounts effective for reducing photographic speed change upon storage, a compound of formula I as defined hereinabove and a compound of formula II as defined hereinabove in which the compound of formula I is present in about 0.01 mmole to about 10 mmoles per mole silver, preferably about 0.01 to about 1.0 mmoles per mole silver, and the compound of formula II is present at about 0.5 mole to about 20 moles per mole of the compound of formula I, preferably about 5 to about 20 moles per mole of compound of formula I.

In a further aspect, the invention is the emulsion in combination with a paper support of neutral pH, in which the emulsion is coated on the support to form a photographic material.

In another aspect, the emulsion includes a soluble chloride salt, such as sodium chloride or potassium chloride, in such a concentration to provide a coating density of about 1 to 20 mg/ft$^2$, and has a pH in the range of about 4.5 to about 6.0.

The skilled will recognize that other components or addenda may be present in an emulsion in accordance with the present invention to protect the physical integrity of the coating on a support. Such addenda are conventional.

The photographic materials according to the present invention are exposed and developed according to various processes known to the skilled. Preferably, the processing for a color emulsion is a three-step procedure including development, bleach-fix and stabilization.

The present invention is further explained by the following examples which should not be construed by way of limiting the scope of the present invention.

EXAMPLE 1

Emulsions in accordance with the present invention were made by adding potassium p-toluene thiosulfonate (TSS) and sodium p-toluene sulfinate (TS) to a chemically and red spectrally sensitized monodisperse silver chloride negative emulsion having 0.18g Ag/m$^2$, cyan-dye forming coupler 2-(alpha(2,4-ditert-amyl-phenoxy)-butyramido)-4,6-dichloro-5-ethyl phenol (0.42 g/m$^2$) in di-n-butyl phthalate coupler solvent (0.429 g/m$^2$ or 7.716% total in solution), and gelatin (1.08 g/m$^2$), so that the ratio by weight of TSS to TS was 1:5 (molar ratio 1:7). Emulsion samples 1, 2 and 3 were prepared with varying amounts of TSS and TS. The amounts are given as mg/mole Ag of TSS and TS as shown in Table (I).

The light-sensitive emulsion layers were then coated on a paper support (Kodak EKTACOLOR 2001 paper), and were overcoated with a gelatin layer (1.35 g/m$^2$) and hardened with bis(vinylsulfonyl) methyl ether in an amount of 1.8% of the total gelatin weight.

To test the effect of the combined presence of potassium p-toluene thiosulfonate and sodium p-toluene sulfinate on the emulsion, emulsion samples 4, 5, 6 were prepared as described above except only TSS was added to the emulsion with the mg/mole Ag values given in Table (I). Emulsion sample 7 was also prepared as described above except that only TS, in an amount of 600 mg/mole Ag, was added. Control emulsion sample 8 was also prepared as described above but without addition of the TSS or TS.

The speed and fog density ($d_{min}$) for each emulsion sample were determined for the fresh emulsion at 0° F. by methods conventional in the art. The speed is defined as the amount of light required to reach a density of 1.0 on the developed strip. Fog density is defined as the minimum density of the coating. The coated emulsions were then stored for 1 week at 120° F. and 50% relative humidity, and for 3 days at 140° F. and 50% relative humidity and then developed. The development processing consisted of a three-steps--(i) color development (45 sec), (ii) bleach-fix (45 sec) and (iii) stabilization (90 sec) followed by drying (60 sec) at 60° C. The developer, bleach-fix and stabilizer solutions were as follows:

| | |
|---|---|
| **Color Developer** | |
| Lithium salt of sulfonated polystyrene (30% by wt) | 0.25 mL |
| Triethanolamine | 11.0 mL |
| N, N-diethylhydroxylamine (85% by wt) | 6.0 mL |
| Potassium sulfite (45% by wt) | 0.5 mL |
| Color developing agent 4-(N-ethyl-N-2 methanesulfonylaminoethyl) -2-methyl-phenylenediaminesesquisulfate monohydrate | 5.0 g |
| Kodak Ektaprint 2 Stain-Reducing Agent (a stilbene material commercially available from Eastman Kodak Co.) | 2.3 g |
| Lithium sulfate | 2.7 g |
| Potassium chloride | 2.5 g |
| Potassium bromide | 0.025 g |
| Kodak Anti-Cal No. 5 (an organic phosphonic acid material commercially available from Eastman Kodak Co.) | 0.8 mL |
| Potassium carbonate (in water to total of 1 liter, pH adjusted to 10.12) | 25.0 g |
| **Bleach-fix** | |
| Ammonium thiosulfate | 58.0 g |
| Sodium sulfite | 8.7 g |
| Ethylenediaminetetraacetic acid ferric ammonium salt | 40.0 g |
| Acetic acid (in water to total 1 liter, pH adjusted to 6.2) | 9.0 mL |
| **Stabilizer** | |
| Sodium citrate | 1.0 g |
| Dearside (a biocide produced by Rohm and Haas) (in water to total 1 liter, pH adjusted to 7.2 | 45.0 ppm |

For each storage period, the changes in speed (Δ speed) and in fog growth (Δ fog) were measured for each emulsion sample and the results are given below in Table (I). Speed is given in units of log E (exposure)×100. Fog is given in density units.

TABLE (I)

EFFECT OF THIOSULFONATE AND SULFINATE ON STORAGE

| Emulsion Sample # | TSS (mg/mole Ag) | TS (mg/mole Ag) | Fresh Emulsion 0° F. Speed | Fog |
|---|---|---|---|---|
| 1 | 15 | 75 | 174 | 0.12 |
| 2 | 30 | 150 | 174 | 0.12 |
| 3 | 60 | 300 | 172 | 0.12 |
| 7 | 0.0 | 600 | 172 | 0.12 |
| 4 | 15 | 0.0 | 166 | 0.12 |
| 5 | 30 | 0.0 | 164 | 0.11 |
| 6 | 60 | 0.0 | 158 | 0.12 |
| 8 | 0.0 | 0.0 | 172 | 0.12 |

| After 1 week 120° F. Δ Speed | Δ Fog | After 3 days 140° F. Δ Speed | Δ Fog |
|---|---|---|---|
| 3 | 0.1 | 4 | 0.12 |
| 2 | 0.07 | 4 | 0.10 |
| −0.2 | 0.04 | 1 | 0.05 |
| 6 | 0.15 | 8 | 0.17 |

TABLE (I)-continued

EFFECT OF THIOSULFONATE AND SULFINATE ON STORAGE

| | | | |
|---|---|---|---|
| 5 | 0.09 | 6 | 0.10 |
| 3 | 0.07 | 4 | 0.06 |
| 3 | 0.04 | 3 | 0.04 |
| 5 | 0.15 | 9 | 0.19 |

The results in Table (I) show that sodium p-toluene sulfinate alone is basically inactive in reducing speed gain and fog growth (compare control sample 8 with sample 7). For samples 4, 5, and 6, in which only potassium p-toluene thiosulfonate was added, the change in speed and fog growth relative to the control was reduced compared to the control. Samples 4, 5 and 6, however, showed a loss in emulsion sensitivity caused by the addition of potassium p-toluene thiosulfonate alone (compare samples 4, 5 and 6 with control for speed at 0° F.). In samples 1, 2, 3, both speed change and fog growth were substantially reduced compared to the control, while emulsion sensitivity was advantageously maintained.

EXAMPLE 2

In this example, illustrations are provided of the advantageous additive effect of adding TSS and TS to an emulsion in combination with other known anti-fog-gants—potassium chloride and neutral pH paper support.

To test the effect of coating the emulsion on neutral pH paper support, emulsion samples 9, 10 and 15 were prepared with the addition of TSS-TS as described in Example 1 above, except the ratio of TSS to TS was 1:10 (w/w). Emulsion samples 9 and 10 were coated on a normal (acidic, pH about 5.3) paper. Emulsion sample 15 was coated on a paper support whose pH had been adjusted to 6.58 with sodium bicarbonate in the paper manufacturing process. Control emulsion samples 11 and 16 (without TSS or TS) were also prepared; sample 11 was coated on a normal (acidic) paper, while sample 16 was coated on the neutral pH paper described above.

To test the combined effects of the presence of TSS, TS and KCl in an emulsion, samples 12 and 13 were prepared in which the TSS to TS ratio was 1:10 (w/w) as described above and potassium chloride (1.9 mg/ft$^2$) was added to the emulsion. Samples 12 and 13 were coated on normal (acidic) paper support. Control emulsion sample 14 (containing no TSS or TS) was also prepared, treated with KCl and coated on a normal paper support (pH about 5.3).

The fresh emulsion speed and fog ($d_{min}$) were determined for each sample at 0° F.. The samples were then stored for 2 weeks at 120° F. and 50% relative humidity, and 3 days at 140° F. and 50% humidity. The changes in speed and fog were determined for each sample at the end of each storage period and the results are given in Table (II).

TABLE (II)

EFFECT OF THIOSULFONATE AND SULFINATE PLUS KCl AND/OR NEUTRAL pH PAPER SUPPORT ON STORAGE

| Emulsion Sample # | TSS (mg/mole Ag) | TS (mg/mole Ag) | KCl (1.9 mg/ft$^2$) | Acidity of Paper Support |
|---|---|---|---|---|
| 9 | 60 | 600 | no | acidic |
| 10 | 240 | 2400 | no | acidic |
| 11 | 0.0 | 0.0 | no | acidic |
| 12 | 60 | 600 | yes | acidic |
| 13 | 240 | 2400 | yes | acidic |
| 14 | 0.0 | 0.0 | yes | acidic |
| 15 | 60 | 600 | no | neutral |
| 16 | 0.0 | 0.0 | no | neutral |

| Fresh Emulsion 0° F. | | 120° F. | | 140° F. | |
|---|---|---|---|---|---|
| Speed | Fog | Δ Speed | Δ Fog | Δ Speed | Δ Fog |
| 169 | 0.11 | 4 | 0.19 | 1 | 0.09 |
| 168 | 0.11 | 2 | 0.08 | 3 | 0.04 |
| 168 | 0.11 | 20 | 0.51 | 14 | 0.32 |
| 164 | 0.11 | 2 | 0.07 | 0 | 0.04 |
| 163 | 0.11 | −2 | 0.04 | 0 | 0.02 |
| 158 | 0.11 | 2 | 0.14 | 2 | 0.08 |
| 166 | 0.11 | −2 | 0.01 | −1 | 0.02 |
| 169 | 0.11 | −2 | 0.06 | −2 | 0.06 |

The results of Table (II) illustrate that the reduction in speed gain and fog growth with the combination of potassium p-toluene thiosulfonate-sodium p-toluene sulfinate and KCl in an emulsion coated on normal paper support is additive. Comparison of control sample 11 with control sample 14 (KCl alone added) illustrates the known effect of KCl to reduce fog growth on storage. The results for samples 12 and 13 illustrate the additive effect of the combination of potassium p-toluene thiosulfonate-sodium p-toluene sulfinate with KCl when using a normal paper support.

The results with sample 16 illustrate the known reduction in fog growth on storage using a neutral pH paper support. The addition of potassium p-toluene thiosulfonate-sodium p-toluene sulfinate to the emulsion of sample 15 shows an additive effect, especially for the 3 day storage period.

EXAMPLE 3

In this example, illustrations are provided of the advantageous effect on reducing speed gain and fog growth upon storage, produced by combining addition of TSS-TS to an emulsion along with adjustment of the pH of the emulsion, to the acidic as well as addition of KCl.

TSS and TS were added to a chemically and blue spectrally sensitized monodisperse silver chloride negative emulsion (0.34 g Ag/m$^2$), yellow-dye forming coupler alpha-(4-(4-benzyloxy-phenyl-sulfonyl)-phenoxy)alpha(pivalyl)-2-chloro-5-(gamma-(2,4-di-5-amylphenoxy)butyramido)acetanilide (1.08 g/m$^2$) in di-n-butylphthalate coupler solvent (0.27 g/m$^2$), and gelatin (1.51 g/m$^2$) so that the ratio of TSS to TS was 1:10 (w/w). Emulsion samples 17 and 18 were prepared with TSS and TS only.

Emulsion samples 20 and 21 were prepared with TSS-TS as described above but also the pH of the emulsion was adjusted to pH 5.0 by the addition of nitric acid ($HNO_3$)(1.67 M). Emulsion samples 23 and 24 were prepared with the addition of TSS-TS and KCl (1.9 mg/ft$^2$). Emulsion samples 26 and 27 were prepared with the addition of TSS-TS, KCl (1.9 mg/ft$^2$) and, in addition, the pH was adjusted to pH 5.0 with $HNO_3$.

Control samples were prepared as follows: sample 19 was prepared with no TSS-TS, KCl or pH adjustment; sample 22 contained no TSS-TS or KCl but the pH was adjusted to 5.0 with $HNO_3$; sample 25 contained no TSS-TS but included KCl; and sample 28 contained no TSS-TS but included KCl and, for pH adjustment, $HNO_3$.

All emulsions were coated on a normal paper support (Kodak EKTACOLOR 2001 paper).

Fresh speed and fog were determined for each sample as described in Example 1 above. The coated emulsion samples were stored for 4 weeks at 120° F. and 50% relative humidity. The changes in speed and fog were determined for each sample at the end of the storage period and the results are given in Table (III).

TABLE (III)

EFFECT OF THIOSULFONATE AND SULFINATE PLUS KCl AND/OR pH ADJUSTMENT OF EMULSION ON STORAGE

| Emulsion Sample # | TSS (mg/mole Ag) | TS (mg/mole Ag) | KCl (1.9 mg/ft$^2$) | Added $HNO_3$ to pH 5.0 | Fresh Emulsion 0° F. Speed | Fresh Emulsion 0° F. Fog | After 4 weeks 120° F. Δ Speed | After 4 weeks 120° F. Δ Fog |
|---|---|---|---|---|---|---|---|---|
| 17 | 60 | 600 | no | no | 138 | 0.04 | 16 | 0.18 |
| 18 | 240 | 2400 | no | no | 137 | 0.05 | 7 | 0.11 |
| 19 | 0.0 | 0.0 | no | no | 138 | 0.05 | 29 | 0.30 |
| 20 | 60 | 600 | no | yes | 136 | 0.04 | 21 | 0.10 |
| 21 | 240 | 2400 | no | yes | 137 | 0.04 | 8 | 0.09 |
| 22 | 0.0 | 0.0 | no | yes | 138 | 0.05 | 27 | 0.25 |
| 23 | 60 | 600 | yes | no | 137 | 0.05 | 23 | 0.13 |
| 24 | 240 | 2400 | yes | no | 135 | 0.04 | 14 | 0.10 |
| 25 | 0.0 | 0.0 | yes | no | 138 | 0.05 | 32 | 0.17 |
| 26 | 60 | 60 | yes | yes | 137 | 0.05 | 19 | 0.10 |
| 27 | 240 | 240 | yes | yes | 136 | 0.04 | 11 | 0.07 |
| 28 | 0.0 | 0.0 | yes | yes | 137 | 0.05 | 29 | 0.13 |

The results for sample 22 illustrate a small effect on reducing storage-related changes in speed and fog growth by pH adjustment by addition of $HNO_3$ compared to the control sample 19. The results with samples 20 and 21 illustrate the additive effect of combining potassium p-toluene thiosulfonate-sodium p-toluene sulfinate addenda and pH adjustment with $HNO_3$. The results for sample 25 compared to control sample 19 illustrate the reduction in fog growth during storage effected by addition of KCl alone, while the results for samples 23 and 24 versus sample 25 illustrate the additive effect, in reducing speed gain and fog growth during storage, of combining potassium p-toluene thiosulfonate-sodium p-toluene sulfinate with KCl. The results with sample 28 show the effect on such changes during storage achieved by the combination of KCl and pH adjustment by $HNO_3$. The results with samples 26 and 27 show the further improvement in reducing changes in speed and fog growth during storage by the addition of potassium p-toluene thiosulfonate-sodium p-toluene sulfinate to the KCl-$HNO_3$ combination.

While the present invention has now been described and exemplified with some specificity, those skilled in the art will appreciate the various modifications, including variations, additions and omissions, that may be made in what has been disclosed herein without departing from the spirit of the invention. Accordingly, it is intended that these modifications also be encompassed by the present invention and that the scope of the present invention be limited solely by the broadest interpretation that lawfully can be accorded the appended claims.

What is claimed:

1. A method for reducing speed change on aging in a silver halide photographic material, which comprises a negative photographic emulsion coated on a paper support, said emulsion comprising crystals of a compound selected from the group consisting of silver chloride and : silver bromochloride, said method comprising treating said emulsion with an amount effective for reducing speed change upon storage of said photographic material of a compound of formula I:

$$Z^1—X^1O_2S—M^1 \quad (I)$$

and a compound of formula II:

$$Z^2—X^2O_2—M^2 \quad (II)$$

wherein $X^1$ is sulfur and $X^2$ is selected from the group consisting of sulfur and selenium, $M^1$ and $M^2$ are independently selected from the group consisting of an alkali metal ion and

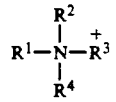

wherein $R^1$, $R^2$, $R^3$ and $R^4$ are independently selected from the group consisting of hydrogen and an alkyl of 1-3 carbon atoms, and $Z^1$ and $Z^2$ are independently selected from the group consisting of an unsubstituted or substituted alkyl of 1 to 18 carbon atoms, an unsubstituted or substituted aryl group having 6 to 10 carbon atoms, an unsubstituted or substituted 5-membered or 6-membered heterocyclic group having one or two heteroatoms, and L, wherein L is a divalent linking group, provided that, if $Z^1$ is L, the compound of formula I is a polymer and, if $Z^2$ is L, the compound of formula II is a polymer.

2. The method of claim 1 wherein, in the photographic emulsion, the compound of formula I is present in about 0.01 mmoles to about 10 mmoles per mole silver, and the compound of formula II is present at about 0.5 moles to about 20 moles per mole of the compound of formula I, provided that, if $Z^1$ is L, each polymeric unit comprising the moiety of formula $—X^1O_2S—$ is counted as a molecule of the compound of formula I and, if $Z^2$ is L, each polymeric unit comprising the moiety of formula $—X^2O_2—$ is counted as a molecule of the compound of formula II.

3. The method of claim 1 wherein $X^1$ and $X^2$ are sulfur, $M^1$ and $M^2$ are independently selected from $Na^+$, $K^+$ and

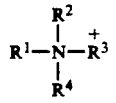

and $Z^1$ and $Z^2$ are independently selected from a phenyl group or a phenyl group substituted at one or two positions independently with a functional group selected from the group consisting of an alkyl having 1 to 10 carbon atoms, an alkoxy having 1 to 10 carbon atoms, an acyl having 1 to 10 carbon atoms, an hydroxyl, a phenyl, a tolyl, a naphthyl, a carboxy, a chloro, a bromo, a nitro, a cyano, an acetamido, a carbamoyl, an ureido, an unsubstituted amino, and an amino substituted with one or two alkyls being the same or different and each having 1 to 3 carbon atoms.

4. The method of claim 3 wherein $M^1$ and $M^2$ are each $Na^+$ or $K^+$, and $Z^1$ and $Z^2$ are each a tolyl group.

5. The method of claim 4 wherein said compound for formula I is present at about 0.01 mmoles to about 1.0 mmoles per mole silver and said compound of formula II is present at about 5 moles to about 20 moles per mole of compound of formula I.

6. The method of any one of claims 1, 2, 3, 4 or 5 wherein said paper support is a paper having a neutral pH.

7. The method of any one of claims 1, 2, 3, 4 or 5 wherein said treating with said compound of formula I and said compound of formula II occurs just prior to applying said emulsion to said paper.

8. The method of any one of claims 1, 2, 3, 4 or 5 further comprising, prior to applying said emulsion to said paper, treating said emulsion with a solution of a soluble chloride.

9. The method of claim 8 wherein said soluble chloride is selected from the group consisting of NaCl and KCl.

10. The method of any one of claims 1, 2, 3, 4 or 5 further comprising, prior to applying said emulsion to said paper, adjusting the pH of said emulsion to a range of about 4.5 to about 6.0

11. A negative silver halide photographic emulsion comprising (1) crystals of a compound selected from the group consisting of silver chloride and silver bromochloride, and (2) a composition comprising, in amounts effective for reducing photographic speed change upon storage, a compound of formula I:

$$Z^1—X^1O_2—M^1 \quad (I)$$

and a compound of formula II.

$$Z^2—X^2O—M^2 \quad (II)$$

wherein $X^1$ is sulfur and $X^2$ is selected from the group consisting of sulfur and selenium, $M^1$ and $M^2$ are independently selected from the group consisting of an alkali metal ion and

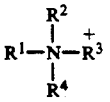

wherein $R^1$, $R^2$, $R^3$ and $R^4$ are independently selected from the group consisting of hydrogen and an alkyl of 1-3 carbon atoms, and $Z^1$ and $Z^2$ are independently selected from the group consisting of an unsubstituted or substituted alkyl of 1 to 18 carbon atoms, an unsubstituted or substituted aryl group having 6 to 10 carbon atoms, an unsubstituted or substituted 5-membered or 6-membered heterocyclic group having one or two heteroatoms, and L, wherein L is a divalent linking group, wherein the compound of formula I is present in about 0.01 mmoles to about 10 mmoles per mole silver, and the compound of formula II is present at about 0.5 moles to about 20 moles per mole of the compound of formula I, provided that, if $Z^1$ is L, the compound of formula I is a polymer and, if $Z^2$ is L, the compound of formula II is a polymer, and provided further that, if the compound of formula I is a polymer, each polymeric unit comprising the moiety of formula $—X^1O_2S—$ is counted as a molecule of the compound of formula I and, if the compound of formula II is a polymer, each polymeric unit comprising the moiety of formula $—X^2O_2—$ is counted as a molecule of the compound of formula II.

12. The emulsion of claim 11 wherein $X^1$ and $X^2$ are sulfur, $M^1$ and $M^2$ are independently selected from $Na^+$, $K^+$ and

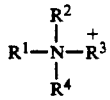

and $Z^1$ and $Z^2$ are independently selected from an unsubstituted phenyl group or a phenyl group substituted in one or two positions independently with a functional group selected from the group consisting of an alkyl having 1 to 10 carbon atoms, an alkoxy having 1 to 10 carbon atoms, an acyl having 1 to 10 carbon atoms, an hydroxyl, a phenyl, a tolyl, a naphthyl, a carboxy, a chloro, a bromo, a nitro, a cyano, an acetamido, a carbamoyl, an ureido, an unsubstituted amino, and an amino substituted with one or two alkyls being the same or different and each having 1 to 3 carbon atoms.

13. The emulsion of claim 12 wherein $M^1$ and $M^2$ are each $Na^+$ or $K^+$ and $Z^1$ and $Z^2$ are each a tolyl group.

14. A photographic material comprising, a paper support of neutral pH and the emulsion of claim 17 coated thereon.

15. A method for reducing speed change on aging in a photographic material, which comprises a negative photographic emulsion coated on a paper support, said emulsion comprising crystals of a compound selected from the group consisting of silver chloride and, silver bromochloride, said method comprising treating said emulsion with an amount effective for reducing fog growth upon storage of said photographic material of a compound of formula I:

$$Z^1—X^1O_2—M^1 \quad (I)$$

and a compound of formula II:

$$Z^2—X^2O—M^2 \quad (II)$$

wherein $X^1$ is sulfur and $X^2$ is selected from the group consisting of sulfur and selenium, $M^1$ and $M^2$ are independently selected from the group consisting of an alkali metal ion and

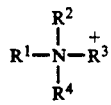

wherein $R^1$, $R^2$, $R^3$ and $R^4$ are independently selected from the group consisting of hydrogen and an alkyl of 1-3 carbon atoms, and $Z^1$ and $Z^2$ are independently selected from the group consisting of an unsubstituted or substituted alkyl of 1 to 18 carbon atoms, an unsubstituted or substituted aryl group having 6 to 10 carbon atoms, an unsubstituted or substituted 5-membered or 6-membered heterocyclic group having one or two heteroatoms, and L, wherein L is a divalent linking group, provided that, if $Z^1$ is L, the compound of formula I is a polymer and, if $Z^2$ is L, the compound of formula II is a polymer

16. The method of claim 15, wherein $X^1$ and $X^2$ are sulfur, $M^1$ and $M^2$ are independently selected from $Na^+$, $K^+$ and

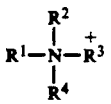

and $Z^1$ and $Z^2$ are independently selected from an and Z unsubstituted phenyl group or a phenyl group substituted in one or two positions independently with a functional group selected from the group consisting of an alkyl having 1 to 10 carbon atoms, an alkoxy having 1 to 10 carbon atoms, an acyl having 1 to 10 carbon atoms, an hydroxyl, a phenyl, a tolyl, a naphthyl, a carboxy, a chloro, a bromo, a nitro, a cyano, an acetamido, a carbamoyl, an ureido, an unsubstituted amino, and an amino substituted with one or two alkyls being the same or different and each having 1 to 3 carbon atoms.

17. The method of claim 16, wherein $M^1$ and $M^2$ are each $Na^+$ or $K^+$, and $Z^1$ and $Z^2$ are each a tolyl group.

18. The method of any one of claims 15, 16 or 17 wherein said emulsion is applied to a paper support having a neutral pH to form the photographic material.

19. The method of claim 18, further comprising, prior to applying said emulsion to said paper support, adjusting the pH of said emulsion to a range of about 4.5 to about 6.0

20. The method of claim 19 further comprising prior to applying said emulsion to said paper support, treating said emulsion with a solution of a soluble chloride.

21. The method of claim 20 wherein said soluble chloride is selected from the group consisting of NaCl and KCl.

* * * * *

IN THE UNITED STATES PATENT AND TRADEMARK OFFICE

CERTIFICATE OF CORRECTION

PATENT NO. : 5,292,635

DATED : March 8, 1994

INVENTOR(S) : Roger Lok

It is certified that errors appear in the above-identified patent and that said Letters Patent is hereby corrected as shown below:

Col 13, line 11, "for" should read -- of --.

Col 14, line 35, "17" should read -- 11 --.

Col 15, line 16, delete "and Z".

Signed and Sealed this

Eleventh Day of October, 1994

*Attest:*

*Attesting Officer*

Bruce Lehman

BRUCE LEHMAN

*Commissioner of Patents and Trademarks*